US010405666B1

(12) United States Patent
Reus

(10) Patent No.: US 10,405,666 B1
(45) Date of Patent: Sep. 10, 2019

(54) RECONFIGURABLE CHAIR SYSTEM

(71) Applicant: Scott A. Reus, Indian Rocks Beach, FL (US)

(72) Inventor: Scott A. Reus, Indian Rocks Beach, FL (US)

( * ) Notice: Subject to any disclaimer, the term of this patent is extended or adjusted under 35 U.S.C. 154(b) by 0 days.

(21) Appl. No.: 15/852,850

(22) Filed: Dec. 22, 2017

(51) Int. Cl.

| | |
|---|---|
| ***A47C 3/026*** | (2006.01) |
| ***A47C 3/20*** | (2006.01) |
| ***A47C 3/30*** | (2006.01) |
| ***A47C 7/50*** | (2006.01) |
| ***A47C 7/54*** | (2006.01) |
| ***A47C 7/40*** | (2006.01) |

(52) U.S. Cl.
CPC ..... *A47C 7/40* (2013.01); *A47C 3/30* (2013.01); *A47C 7/506* (2013.01); *A47C 7/54* (2013.01)

(58) Field of Classification Search
CPC .. A47C 7/40; A47C 7/506; A47C 7/54; A47C 3/30
USPC ..... 297/383, 423.26, 423.27, 423.28, 423.37
See application file for complete search history.

(56) References Cited

U.S. PATENT DOCUMENTS 1,590,240 A * 6/1926 Gorton ..... A47C 9/02 297/423.38 X
2,437,940 A * 3/1948 Cramer ..... A47C 3/26 297/423.38 X
3,151,910 A * 10/1964 Larson ..... A01K 97/10 297/423.26 X
3,477,673 A * 11/1969 Bereday ..... A47C 9/025 248/121
3,511,533 A * 5/1970 Drabert ..... A47C 1/023 297/337
3,642,320 A * 2/1972 Ward ..... A47C 3/18 297/423.37 X
3,754,787 A * 8/1973 Garber ..... A47C 9/025 297/195.11
3,820,844 A * 6/1974 Fortnam ..... A47C 7/52 297/423.37 X
4,063,321 A * 12/1977 Nichols ..... B63B 29/06 297/423.19 X
4,148,524 A * 4/1979 Guyton ..... A47C 7/506 297/423.26 X
4,408,801 A * 10/1983 Edel ..... A47C 3/18 297/423.26 X
4,426,115 A * 1/1984 Bissonnette ..... A47C 7/506 297/423.27
4,597,356 A * 7/1986 McCaghren ..... B63B 29/04 114/153

(Continued)

*Primary Examiner* — Rodney B White
(74) *Attorney, Agent, or Firm* — Beusse, Wolter, Sanks & Maire PLLC; Robert L. Wolter

(57) ABSTRACT

Left and right fixed arm plates extend upwardly from the seat of a chair. A left movable arm plate is above the left fixed arm plate and a right movable arm plate is above the right fixed arm plate. Parallel left links couple the left fixed plate and the left movable plate in parallelogram manner. Parallel right links couple the right fixed plate and the right movable plate in parallelogram manner. A left arm rest is coupled to the left movable plate and a right arm rest is coupled to the right movable plate. A gas lift cylinder including an upper cylinder secured to the seat reciprocable within a lower cylinder. The upper cylinder is urged upwardly. A bracket rotatably couples a lower foot support to a lower cylinder. A leaf spring couples the seat and the bracket.

19 Claims, 4 Drawing Sheets

(56) References Cited

U.S. PATENT DOCUMENTS 4,655,504 A * 4/1987 Weber ..... A47C 1/124 297/423.27 X
4,722,706 A * 2/1988 Young ..... B63B 29/04 114/153
4,768,831 A * 9/1988 Liedberg ..... A47C 9/02 297/423.38 X
5,029,941 A * 7/1991 Twisselmann ..... A61B 90/60 297/344.13
5,039,167 A * 8/1991 Sweet ..... A47C 1/04 297/423.28
5,149,174 A * 9/1992 Charash ..... A47C 9/005 248/125.1
5,152,581 A * 10/1992 Norsworthy ..... A47C 7/506 297/423.28 X
5,186,519 A * 2/1993 Larson ..... A47C 9/005 297/338
5,199,763 A * 4/1993 Wilder ..... A47C 9/025 297/15
5,295,728 A * 3/1994 Schaevitz ..... A47C 9/025 297/195.1
5,303,981 A * 4/1994 Wilder ..... A47C 9/025 297/14
5,330,254 A * 7/1994 Larson ..... A47C 9/005 297/338
5,346,415 A * 9/1994 Waymon ..... B63B 29/06 297/344.21 X
5,582,464 A * 12/1996 Maymon ..... A47C 7/70 297/423.26 X
5,630,648 A * 5/1997 Allard ..... A47C 7/029 297/327
5,795,017 A * 8/1998 Zimmerman ..... B63B 29/04 297/423.28 X
5,873,628 A * 2/1999 Allard ..... A47C 7/029 297/326
5,904,398 A * 5/1999 Farricielli ..... A61G 5/00 297/423.28 X
6,244,662 B1 * 6/2001 Porcheron ..... A61G 5/14 297/383
6,533,360 B1 * 3/2003 Parkel ..... A47C 7/506 297/423.28
6,877,812 B2 * 4/2005 Congleton ..... A47C 7/40 297/383 X
7,093,900 B1 * 8/2006 Schon ..... A47C 9/002 297/259.4
7,234,768 B2 * 6/2007 Manning ..... A47C 7/38 297/383
7,252,336 B2 * 8/2007 Frisina ..... B60N 2/1695 297/118
7,252,337 B2 * 8/2007 Hofmann ..... B60N 2/20 297/383 X
7,261,368 B1 * 8/2007 Clausnitzer ..... A47C 3/026 297/112
7,422,287 B2 * 9/2008 Heidmann ..... A47C 7/405 297/284.4
7,611,207 B2 * 11/2009 Barfuss ..... A47C 1/06 297/423.28 X
7,618,090 B2 * 11/2009 Grenon ..... A47C 3/18 297/383 X
7,887,136 B2 * 2/2011 Zoell ..... A47C 9/025 297/284.3
8,220,872 B2 * 7/2012 Hong ..... A47C 3/30 297/312
8,534,762 B2 9/2013 Linhoff
8,602,496 B2 12/2013 Lu
8,931,848 B2 * 1/2015 Archambault ..... B60N 2/90 297/423.26
9,376,197 B1 * 6/2016 Wood ..... B63H 20/12
9,474,377 B2 * 10/2016 Keen ..... A47C 7/506
9,968,195 B2 * 5/2018 Sheinkop ..... A47C 1/022
10,244,870 B1 * 4/2019 Bobst ..... A47C 7/62
2003/0151288 A1 * 8/2003 Deisig ..... A47C 3/20 297/313
2007/0052275 A1 * 3/2007 Ghilzai ..... A47C 1/06 297/423.12
2007/0108805 A1 5/2007 Manning
2008/0084101 A1 4/2008 Powicki
2009/0230748 A1 9/2009 George
2011/0133527 A1 * 6/2011 Taylor ..... A47C 7/506 297/423.37 X
2012/0319444 A1 12/2012 Onopa
2013/0249190 A1 * 9/2013 Engman ..... A61G 5/12 297/423.26 X
2014/0103691 A1 * 4/2014 Boyd ..... A47C 9/007 297/344.18
2015/0196122 A1 7/2015 Lu
2015/0335159 A1 * 11/2015 Kieryllo ..... A47C 7/024 297/283.1
2017/0007027 A1 1/2017 Keen

* cited by examiner

RECONFIGURABLE CHAIR SYSTEM

BACKGROUND OF THE INVENTION

Field of the Invention

The present invention relates to a reconfigurable chair system and more particularly pertains to reconfiguring the system between leaning, sitting, and perch orientations and supporting a user in any of a plurality of orientations in a safe, convenient, and economical manner.

Description of the Prior Art

The use of functional chairs is known in the prior art. More specifically, functional chairs of known designs and configurations previously devised and utilized for the purpose of increasing functionality are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a reconfigurable chair system that allows reconfiguring the system between leaning, sitting, and perch orientations and supporting a user in any of a plurality of orientations in a safe, convenient, and economical manner.

In this respect, the reconfigurable chair system according to the present invention substantially departs from the conventional concepts and designs of the prior art, and in doing so provides an apparatus primarily developed for the purpose of reconfiguring the system between leaning, sitting, and perch orientations and supporting a user in any of a plurality of orientations in a safe, convenient, and economical manner.

Therefore, it can be appreciated that there exists a continuing need for a new and improved reconfigurable chair system which can be used for reconfiguring the system between leaning, sitting, and perch orientations and supporting a user in any of a plurality of orientations in a safe, convenient, and economical manner. In this regard, the present invention substantially fulfills this need.

SUMMARY OF THE INVENTION

In view of the foregoing disadvantages inherent in the known types of functional chairs of known designs and configurations now present in the prior art, the present invention provides an improved reconfigurable chair system. As such, the general purpose of the present invention, which will be described subsequently in greater detail, is to provide a new and improved reconfigurable chair system and method which has all the advantages of the prior art and none of the disadvantages.

To attain this, the present invention essentially comprises a reconfigurable chair system having a seat and a back. Left and right fixed arm plates extend upwardly from the seat. A left movable arm plate is above the left fixed arm plate and a right movable arm plate is above the right fixed arm plate. Parallel left links couple the left fixed plate and the left movable plate in parallelogram manner. Parallel right links couple the right fixed plate and the right movable plate in parallelogram manner. A left arm rest is coupled to the left movable plate and a right arm rest is coupled to the right movable plate.

Next provided is a gas lift cylinder. The gas lift cylinder includes lower and upper cylinders. The upper cylinder is secured to the seat. The upper cylinder is reciprocable within the lower cylinder. The upper cylinder is urged upwardly. A lower foot support is next provided. A bracket rotatably couples the lower foot support to the lower cylinder. A leaf spring couples the seat and the bracket.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reconfigurable chair system which has all of the advantages of the prior art functional chairs of known designs and configurations and none of the disadvantages.

It is another object of the present invention to provide a new and improved reconfigurable chair system which may be easily and efficiently manufactured and marketed.

It is further object of the present invention to provide a new and improved reconfigurable chair system which is of durable and reliable constructions.

An even further object of the present invention is to provide a new and improved reconfigurable chair system which is susceptible of a low cost of manufacture with regard to both materials and labor, and which accordingly is then susceptible of low prices of sale to the consuming public, thereby making such reconfigurable chair system economically available to the buying public.

Lastly, it is another object of the present invention is to provide a reconfigurable chair system for reconfiguring the system between leaning, sitting, and perch orientations and supporting a user in any of a plurality of orientations in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
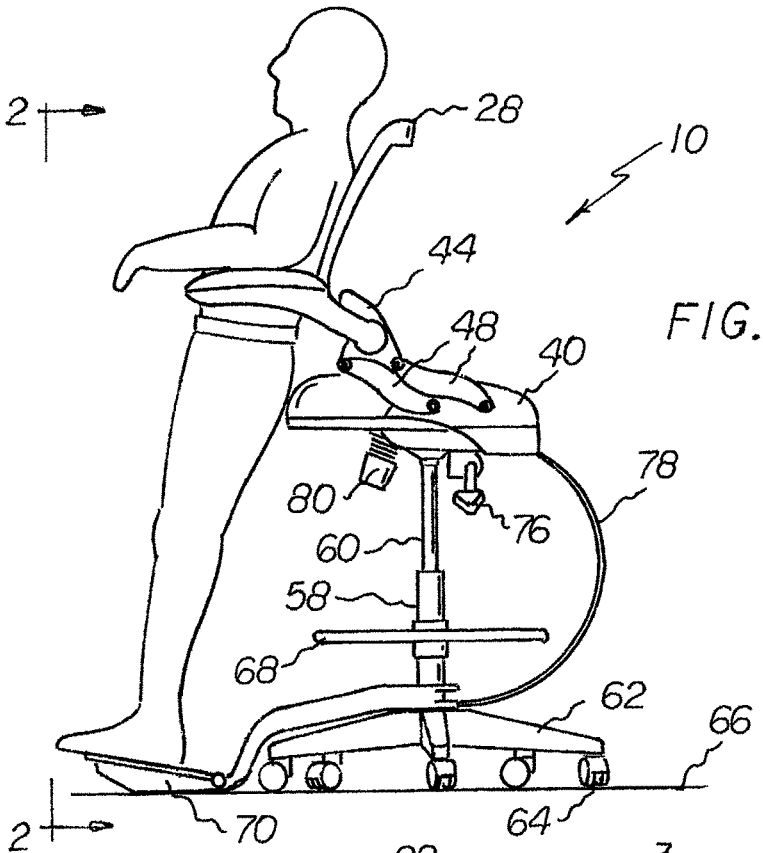
FIG. 1 is a side elevational view of a reconfigurable chair system constructed in accordance with the principles of the present invention, the system being in a leaning orientation.
Figure 2:
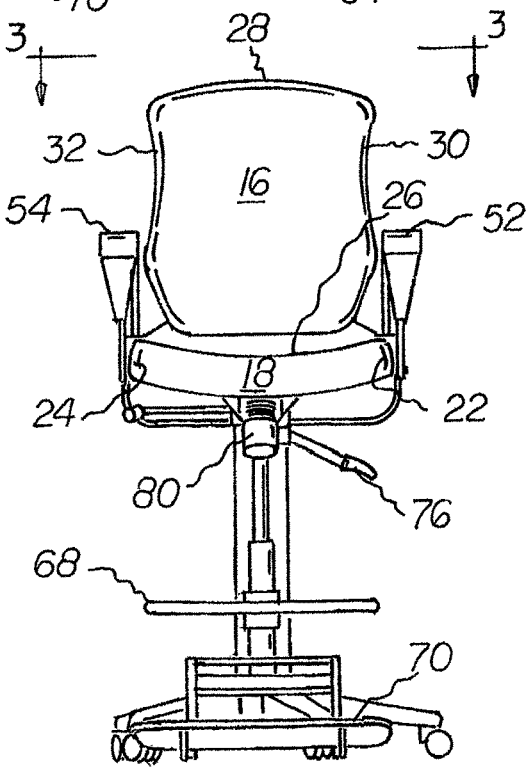
FIG. 2 is a front elevational view taken along line 2-2 of FIG. 1.
Figure 3:
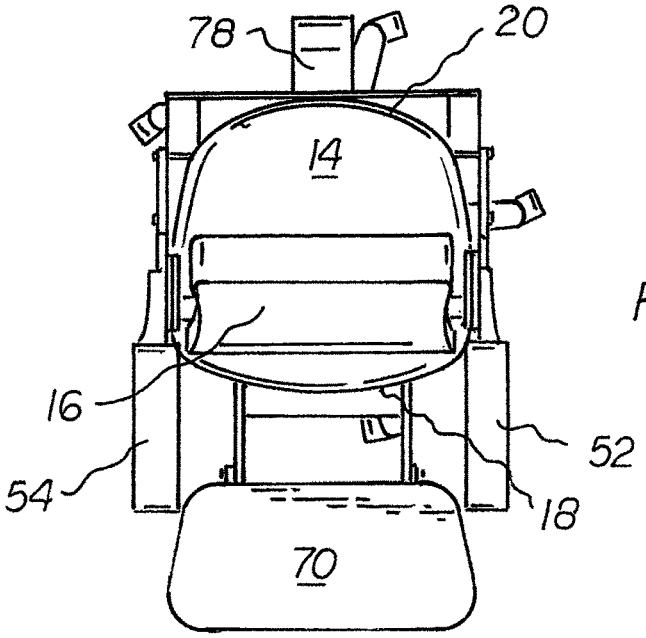
FIG. 3 is a plan view taken along line 3-3 of FIG. 2.

With reference now to the drawings, and in particular to FIG. 1 thereof, the preferred embodiment of the new and improved reconfigurable chair system embodying the principles and concepts of the present invention and generally designated by the reference numeral 10 will be described.

The present invention, the reconfigurable chair system 10 is comprised of a plurality of components. Such components in their broadest context include a seat, a back, left and right fixed arm plates, left and right movable arm plates, left and right arm rests, a gas lift cylinder, a lower foot support, a bracket, and a leaf spring. Such components are individually configured and correlated with respect to each other so as to attain the desired objective.

The reconfigurable chair system 10 is reconfigurable between leaning, sitting, and perch orientations for supporting a user in any of a plurality of orientations. The reconfiguring and the supporting are done in a safe, convenient, and economical manner, A supporting assembly is provided. The supporting assembly includes a seat 14 and a back 16. The seat is generally horizontal with a forward edge 18, a rearward edge 20, a left side edge 22, and a right side edge 24. The back is generally vertical with a downward edge 26, an upward edge 28, a left side edge 30, and a right side edge 32. The downward edge of the back is adjacent to and upwardly of the rearward edge of the seat.

A left arm assembly 36 and a similarly configured right arm assembly 38 are next provided. A left fixed arm plate 40 extends upwardly from the left side edge of the seat. A right fixed arm plate 42 extends upwardly from the right side edge of the seat. A left movable arm plate 44 is provided above the left side edge of the seat. A right movable arm plate 46 is provided above the right side edge of the seat. Two parallel left links 48 couple the left fixed plate and the left movable plate in parallelogram manner. Two parallel right links 50 couple the right fixed plate and the right movable plate in parallelogram manner. A left arm rest 52 is coupled to the left movable plate and repositionable between a forward position and a rearward position. A right arm rest 54 is coupled to the right movable plate and repositionable between a forward position and a rearward position.

Next provided is a retention assembly. The retention assembly includes a gas lift cylinder having a vertical lower cylinder 58 and a vertical upper cylinder 60. The vertical lower cylinder has an upper end and a lower end. The vertical upper cylinder has an upper end and a lower end. The upper end of the vertical upper cylinder is secured to the seat. The lower end of the upper cylinder is vertically reciprocable within the lower cylinder. The upper cylinder is urged upwardly. Five similarly configured legs 62 extend outwardly from the lower end of the lower cylinder. Each leg has a first length. A roller 64 depends from each leg remote from the lower cylinder to facilitate movement of the system over a floor 66.

Figure 4:
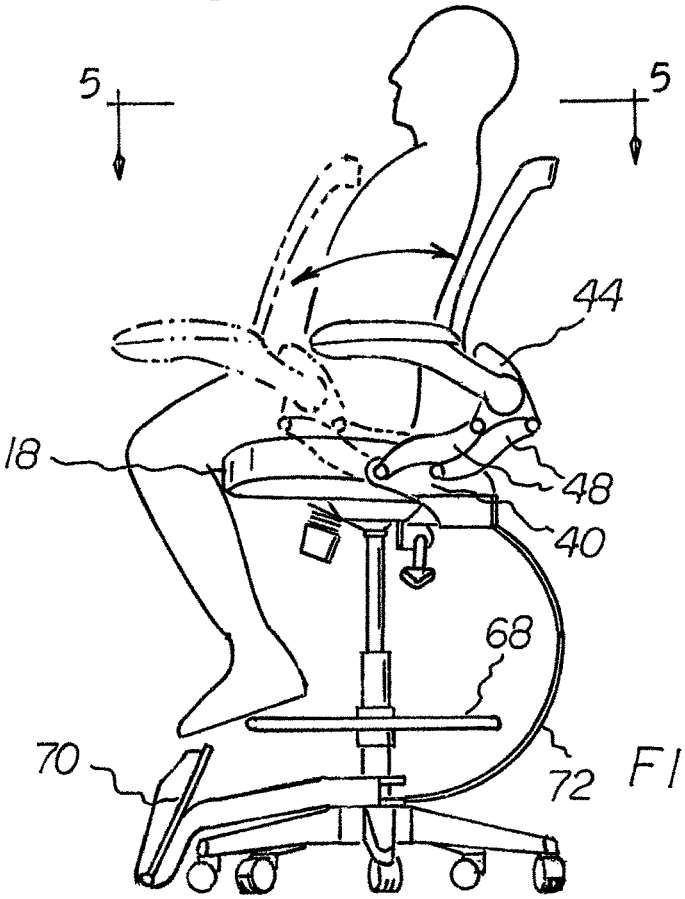
FIG. 4 is a side elevational view of the system, the system being in a sitting orientation.
Figure 5:
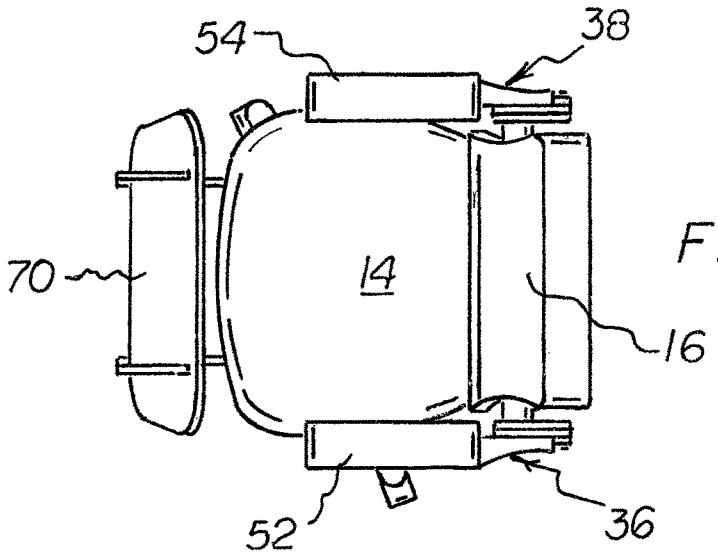
FIG. 5 is a plan view taken along line 5-5 of FIG. 4.
Figure 6:
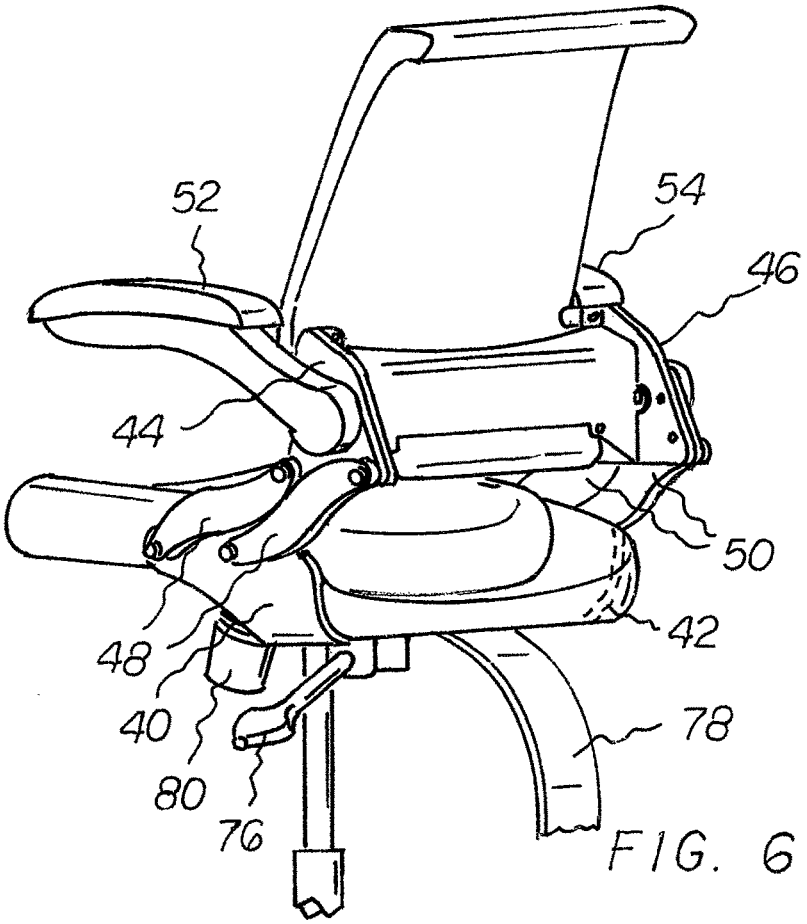
FIG. 6 is a rear perspective illustration of the system shown in the prior Figures.
Figure 7:
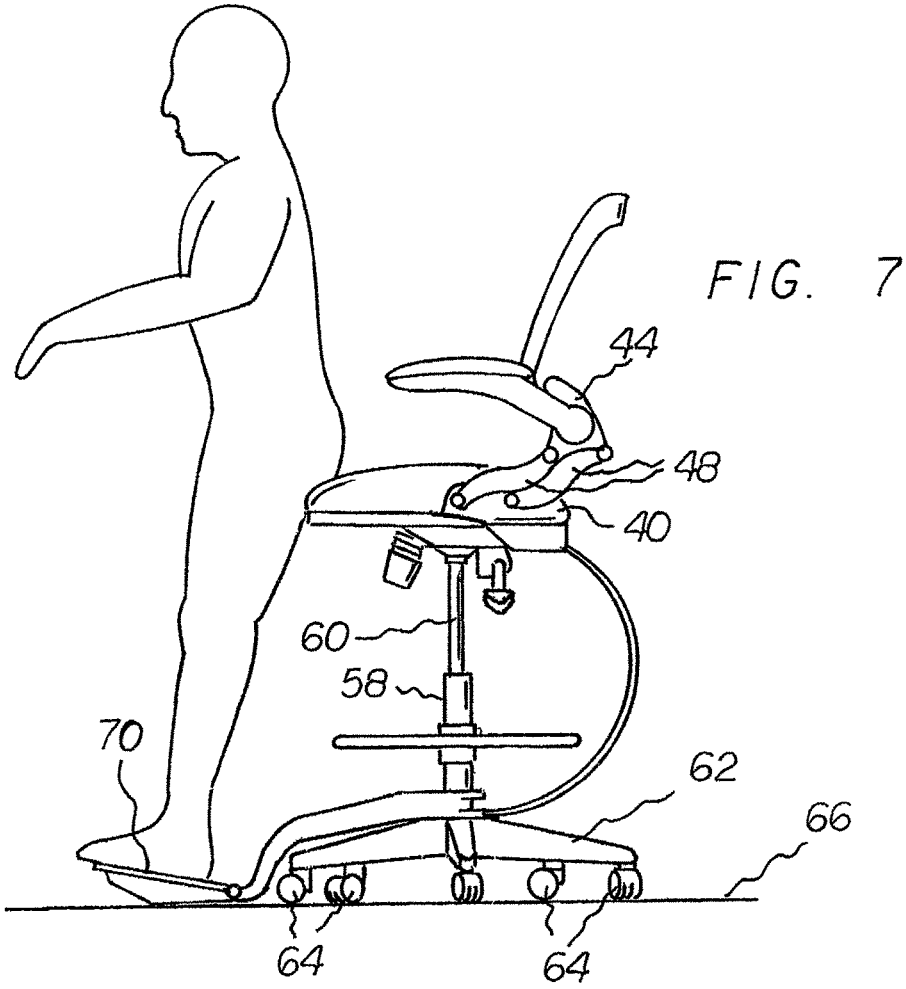
FIG. 7 is a side elevational view of the system, the system being in a perch orientation.
Figure 8:
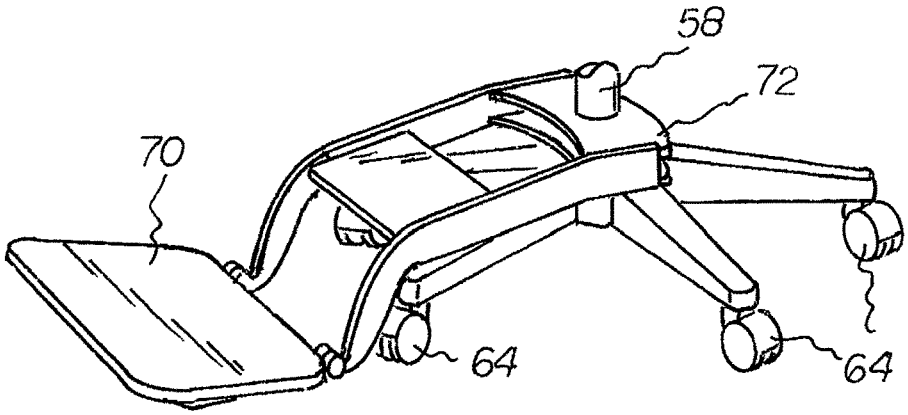
FIG. 8 is a perspective illustration of the lower components of the system.

Next provided is an upper foot support 68. The upper foot support is formed in a circular configuration and is coupled to the lower cylinder at an elevation between the seat and the legs. The upper foot support is adapted to receive the feet of a user when in a sitting orientation. Note FIG. 4. The upper foot support has a diameter of a second length less than the first length of each leg. A lower foot support 70 is next provided. A bracket 72 rotatably couples the lower foot support to the lower cylinder at an elevation below the upper foot support. The lower foot support has a generally rectangular configuration. The lower foot support is spaced from the lower cylinder by a third length greater than the first length of the each leg. The lower foot support is rotatable with respect to the bracket to a lower generally horizontal orientation on the floor for a user's feet when in a perch orientation. Note FIG. 7.

The lower foot support is rotatable with respect to the bracket to a lower generally horizontal orientation on the floor when in a leaning orientation. Note FIG. 1.

A plurality of controls are next provided. The controls include a rod 76 extending outwardly from the upper cylinder which when released locks the upper cylinder with respect to the lower cylinder and which when raised allows adjusting the height of the seat. The controls also include a frustoconical dial 80 to vary the pressure needed on the gas lift cylinder during adjustment.

As to the manner of usage and operation of the present invention, the same should be apparent from the above description. Accordingly, no further discussion relating to the manner of usage and operation will be provided.

With respect to the above description then; it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus, comprising:

a seat rest; a seatback; a linkage connecting the seat rest to the seatback; a column configured to support the seat rest; a freestanding base configured to support the column, to rest on a floor, and to balance the apparatus in an upright orientation; and a lower footrest assembly comprising a bracket secured to the column at a first location above the base and a lower foot support pivotably secured to the bracket at a pivot joint, wherein the bracket is configured to position the pivot joint below the first location and at a bottom of the base so the lower foot support pivots between a folded position where the lower foot support is off the floor and a lowered position where the lower foot support rests on the floor and is configured to support a user standing on the lower foot support;

wherein the linkage is configured to permit movement of the seatback from a rear position relative to the seat rest and associated with a chair configuration of the apparatus to a front position relative to the seat rest and associated with a leaning configuration of the apparatus; and wherein in the leaning configuration the seatback is positioned to support the user when standing forward of the seat rest, leaning on the seatback, and standing on the lower foot support.

2. The apparatus of claim 1, wherein in the leaning configuration a forward edge of the seat rest and the seatback are positioned to simultaneously support respective portions of the user leaning thereon.

3. The apparatus of claim 1, further comprising a connecting bar that connects the bracket to the seat rest, thereby ensuring the lower foot support and the seat rest maintain a same relative orientation.

4. The apparatus of claim 3, wherein the apparatus is configured to permit vertical adjustment of the seat rest, and wherein the connecting bar comprises a leaf spring configured to maintain the same relative orientation regardless of a vertical position of the seat rest.

5. The apparatus of claim 1, wherein the seatback maintains a same orientation relative to the seat rest in the rear position and in the front position.

6. The apparatus of claim 1, wherein the linkage comprises a parallelogram linkage comprising two links, each link of the two links securing the first side of the seat rest to a same side of the seatback.

7. The apparatus of claim 6, wherein each link of the two links rotates at least ninety degrees between the rear position and the front position.

8. An apparatus, comprising:

a seat rest; a column configured to support the seat rest; a lower footrest assembly; and a freestanding base configured to support the column, to rest on a floor, and to balance the apparatus in an upright orientation;

wherein the lower footrest assembly comprises a lower foot support and a bracket, the bracket comprising: a proximal end connected to the column above the base; and a radial extension extending from the proximal end to a vertically downward extension tat ends at a pivot joint disposed at a bottom the base, and wherein the lower foot support pivots about the pivot joint between a folded position where the lower foot support is off the floor and a lowered position where the lower foot support rests on the floor and is configured to support a user standing on the lower foot support.

9. The apparatus of claim 8, wherein the seat rest is configured to rotate about a vertical axis of the column.

10. The apparatus of claim 8, wherein the freestanding base comprises a wheeled base comprising plural wheels, and wherein when in the lowered position contact between the lower foot support and the floor holds the apparatus in place when the user stands on the lower foot support.

11. The apparatus of claim 8, further comprising an upper foot support that is connected to the column between the seat rest and the lower foot support and configured to support feet of the user sitting on the seat rest.

12. The apparatus of claim 8, further comprising a seatback and a linkage connecting the seatback to the seat rest, the linkage configured to move the seatback between a rearward position and a forward position.

13. The apparatus of claim 8, further comprising a leaf spring, wherein the seat rest and the lower foot support are free to rotate about a vertical axis of the apparatus, and wherein the leaf spring is secured to the seat rest and to the proximal end of the bracket and keeps the lower foot support rotationally aligned with the seat rest during rotation of the seat rest and the lower foot support about the vertical axis.

14. An apparatus, comprising:

a seat rest; a seatback; a linkage securing the seat rest to the seatback; a lower foot support; and a column connecting the seat rest to the lower foot support and configured to permit vertical adjustment of the seat rest, wherein the seat rest and the lower foot support are free to rotate about the column;

wherein the linkage is configured to permit movement of the seatback from a rear position relative to the seat rest and associated with a chair configuration of the apparatus to a front position relative to the seat rest and associated with a leaning configuration of the apparatus;

wherein the seat rest remains horizontal in the rear position and the front position; and wherein in the leaning configuration the seat rest and the seatback are positioned to simultaneously support respective portions of a user leaning thereon and standing on the lower foot support; and the apparatus further comprising a leaf spring secured to the seat rest and to the lower foot support and configured to keep the seat rest and the lower foot support rotationally aligned with respect to the column regardless of a vertical position of the seat rest.

15. The apparatus of claim 14, wherein the linkage comprises a parallelogram linkage comprising two links on a first side of the seat rest, each link of the two links securing the first side of the seat rest to a same side of the seatback.

16. The apparatus of claim 15, wherein each link of the two links rotates at least ninety degrees between the rear position and the front position.

17. The apparatus of claim 14, wherein the seatback maintains a same orientation relative to the seat rest in the rear position and in the front position.

18. The apparatus of claim 1, further comprising an upper foot support that is connected to the column at a second location between the seat rest and the first location and configured to support feet of the user when the apparatus is in the chair configuration.

19. The apparatus of claim 1, wherein the seat rest is configured to rotate about a vertical axis of the column.

* * * * *